US007384123B2

(12) United States Patent
Kawatoko et al.

(10) Patent No.: US 7,384,123 B2
(45) Date of Patent: Jun. 10, 2008

(54) INKJET RECORDING APPARATUS AND METHOD FOR ESTIMATING THE AMOUNT OF WASTE INK IN THE INKJET RECORDING APPARATUS

(75) Inventors: Norihiro Kawatoko, Kawasaki (JP); Keiichi Iimoto, Tokyo (JP); Syunichi Kunihiro, Kawasaki (JP); Yuji Hamasaki, Kawasaki (JP); Aya Hayashi, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 479 days.

(21) Appl. No.: 11/201,819

(22) Filed: Aug. 11, 2005

(65) Prior Publication Data
US 2006/0038845 A1 Feb. 23, 2006

(30) Foreign Application Priority Data
Aug. 18, 2004 (JP) ..... 2004-238626

(51) Int. Cl.
*B41J 2/165* (2006.01)

(52) U.S. Cl. ..... 347/36; 347/19

(58) Field of Classification Search ..... 347/14, 347/19, 31, 35–36
See application file for complete search history.

(56) References Cited

U.S. PATENT DOCUMENTS 6,709,088 B2 3/2004 Hayakawa et al. ..... 347/31
7,011,389 B2 * 3/2006 Edamura et al. ..... 347/36

FOREIGN PATENT DOCUMENTS

JP 2001-301201 10/2001

* cited by examiner

*Primary Examiner*—Juanita D. Stephens
(74) *Attorney, Agent, or Firm*—Canon USA Inc I.P. Div

(57) ABSTRACT

A print buffer for storing recording data is divided into a plurality of segments and the amount of recording data causing a recording head to perform a recording operation is counted on a segment-by-segment basis. A recording medium is compared to the print buffer with respect to a scanning direction of the recording head and segments not corresponding to the inside of the recording medium are selected from the plurality of segments. The amount of recording data included in the selected segments and causing a recording operation to occur is counted and added up to estimate the amount of ink ejected outside the recording medium.

8 Claims, 11 Drawing Sheets

FIG. 7

| | HORIZONTAL SIZE | | NUMBER OF BITS | PRINT BUFFER DOT × NUMBER OF BITS | 1 WINDOW (/160) | DEEMED HORIZONTAL WIDTH | ERROR | | | CORRECT VALUE /COUNT | COUNT VALUE /COUNT |
|---|---|---|---|---|---|---|---|---|---|---|---|
| | mm | /600dpi | | | | | (DEEMED DOT) | mm | WINDOW | | |
| | | X_media | B | X_bit | X_win | X' | X-X' | | | | |
| A4 | 210 | 4961 | 4 | 19844 | 124 | 19840 | 4 | 0.04 | 0.03 | 97.9% | 102.1% |
| 5×7 | 127 | 3000 | 4 | 12000 | 75 | 12000 | 0 | 0.00 | 0.00 | 100.0% | 100.0% |
| 4×6 | 101.6 | 2400 | 4 | 9600 | 60 | 9600 | 0 | 0.00 | 0.00 | 100.0% | 100.0% |
| POSTCARD | 100 | 2363 | 4 | 9452 | 59 | 9440 | 12 | 0.13 | 0.20 | 94.0% | 106.4% |
| L SIZE | 89 | 2103 | 4 | 8412 | 52 | 8320 | 92 | 0.97 | 1.77 | 67.3% | 148.7% |
| NAME CARD | 55 | 1300 | 4 | 5200 | 32 | 5120 | 80 | 0.85 | 2.50 | 70.3% | 142.3% |
| CARD | 54 | 1276 | 4 | 5104 | 31 | 4960 | 144 | 1.52 | 4.65 | 56.8% | 176.2% |

FIG. 10

| | HORIZONTAL SIZE | | NUMBER OF BITS | PRINT BUFFER DOT × NUMBER OF BITS | 1 WINDOW (/160) | DEEMED HORIZONTAL WIDTH | ERROR | | | CORRECT VALUE /COUNT | COUNT VALUE /COUNT | IMPROVED VALUE IN FIRST EMBODIMENT |
|---|---|---|---|---|---|---|---|---|---|---|---|---|
| | mm | /600dpi | | | | | (DEEMED DOT) | mm | WINDOW | | | |
| | | X_media | B | X_bit | X_win | X' | X−X' | | | | | |
| A4 | 210 | 4961 | 4 | 19844 | 124 | 19840 | 4 | 0.04 | 0.03 | 97.9% | 102.1% | 102.1% |
| 5×7 | 127 | 3000 | 4 | 12000 | 75 | 12000 | 0 | 0.00 | 0.00 | 100.0% | 100.0% | 100.0% |
| 4×6 | 101.6 | 2400 | 4 | 9600 | 60 | 9600 | 0 | 0.00 | 0.00 | 100.0% | 100.0% | 100.0% |
| POSTCARD | 100 | 2363 | 4 | 9452 | 59 | 9440 | 12 | 0.13 | 0.20 | 94.0% | 106.4% | 106.4% |
| L SIZE | 89 | 2103 | 4 | 8412 | 52 | 8320 | 92 | 0.97 | 1.77 | 67.3% | 148.7% | 121.2% |
| NAME CARD | 55 | 1300 | 4 | 5200 | 32 | 5120 | 80 | 0.85 | 2.50 | 70.3% | 142.3% | 108.5% |
| CARD | 54 | 1276 | 4 | 5104 | 31 | 4960 | 144 | 1.52 | 4.65 | 56.8% | 176.2% | 110.6% |

FIG. 12

| | HORIZONTAL SIZE | | NUMBER OF BITS | PRINT BUFFER DOT × NUMBER OF BITS | 1 WINDOW (/160) | DEEMED HORIZON-TAL WIDTH | ERROR | | | CORRECT VALUE /COUNT | COUNT VALUE /COUNT | IMPROVED VALUE IN SECOND EMBODIMENT |
|---|---|---|---|---|---|---|---|---|---|---|---|---|
| | mm | /600dpi | | | | | (DEEMED DOT) | mm | WINDOW | | | |
| | | X_media | B | X_bit | X_win | X' | X-X' | | | | | |
| A4 | 210 | 4961 | 8 | 39688 | 248 | 39680 | 8 | 0.04 | 0.03 | 97.9% | 102.1% | 102.1% |
| 5×7 | 127 | 3000 | 8 | 24000 | 150 | 24000 | 0 | 0.00 | 0.00 | 100.0% | 100.0% | 100.0% |
| 4×6 | 101.6 | 2400 | 8 | 19200 | 120 | 19200 | 0 | 0.00 | 0.00 | 100.0% | 100.0% | 100.0% |
| POSTCARD | 100 | 2363 | 8 | 18904 | 118 | 18880 | 24 | 0.13 | 0.20 | 94.0% | 106.4% | 106.4% |
| L SIZE | 89 | 2103 | 8 | 16824 | 105 | 16800 | 24 | 0.13 | 0.23 | 94.0% | 106.4% | 106.4% |
| NAME CARD | 55 | 1300 | 8 | 10400 | 65 | 10400 | 0 | 0.00 | 0.00 | 100.0% | 100.0% | 100.0% |
| CARD | 54 | 1276 | 8 | 10208 | 63 | 10080 | 128 | 0.68 | 2.03 | 74.7% | 133.9% | 100.5% |

INKJET RECORDING APPARATUS AND METHOD FOR ESTIMATING THE AMOUNT OF WASTE INK IN THE INKJET RECORDING APPARATUS

BACKGROUND OF THE INVENTION

1. Field of the Invention

The present invention relates to inkjet recording apparatuses for recording by ejecting ink from a recording head onto a recording medium, and to methods in the inkjet recording apparatuses for estimating the amount of waste ink not used for recording. In particular, the present invention relates to a recording apparatus capable of recording by ejecting ink onto the entire surface of a recording medium, and to a method for estimating the amount of waste ink ejected outside a recording medium.

2. Description of the Related Art

Known recording apparatuses, including printers, copiers, and facsimiles, record images by forming dot patterns, based on image information, on a recording medium, such as paper or a thin plastic plate. Examples of recording methods used in such recording apparatuses include an inkjet method, a wire dot recording method, a thermal recording method, and a laser beam recording method.

These days, such recording apparatuses are required to offer high-speed printing capability, high image quality (high resolution), and less noise. Examples of recording apparatuses meeting these requirements include a recording apparatus using an inkjet method (inkjet recording apparatus). An inkjet recording apparatus allows ink (recording liquid) to be ejected from ejection outlets of a recording head, causes ink droplets to adhere to a recording medium, thereby forming images thereon. Since it is not necessary in the inkjet method to bring a recording head into contact with a recording medium, images can be recorded with a constant quality on various types of recording media.

Among inkjet recording apparatuses, a serial-type recording apparatus causing the recording head to reciprocate in a direction (main scanning direction) differing from the feed direction of a recording medium is widely known. The serial-type recording apparatus is capable of recording on recording media of various sizes even with a small recording head. With a plurality of recording heads or with a plurality of nozzle arrays on a recording head, the serial-type recording apparatus can easily accommodate multiple color recording. Moreover, with a recording method in which a recording head scans the same area of a recording medium multiple times, the serial-type recording apparatus can easily adjust the recording speed and image quality by varying the number of scans on the same area. This serial recording method has become widespread rapidly in the market because of its various advantages as described above.

Another type of recording apparatus that is known these days is capable of performing full-surface recording (also called non-blank recording), in which a recording area over which a carriage reciprocates for ejecting ink extends outside a recording medium, and thus recording on the entire surface of the recording medium can be achieved without leaving blank space on the edge of the medium.

This full-surface recording involves recording on the entire surface of a recording medium, and is also called "borderless recording" in contrast with a method of recording on a recording medium, with a border left on the edge thereof. In such a recording apparatus that can accommodate full-surface recording, a platen supporting a recording medium must be prevented from being contaminated with ink ejected outside the recording medium, that is, ink off the edge of the recording medium. Therefore, a waste ink absorber is disposed on a platen or under an opening in a platen to absorb ink ejected outside the recording medium. Such a waste ink absorber provided to achieve full-surface recording is hereinafter referred to as "platen absorber".

However, there is a limit to the amount of ink that can be absorbed in the platen absorber. A problem thus arises in that an increase in the number of sheets for full-surface recording causes ink to overflow from a platen absorber and causes the platen to be contaminated.

For such a recording apparatus capable of performing full-surface recording, some control methods have been proposed to prevent ink from overflowing from a platen absorber.

For example, Japanese Patent Laid-Open No. 2001-301201 (corresponding to U.S. Pat. No. 6,709,088) discloses a structure where a guide unit for a recording medium is provided with an ink receiving hole in which an ink absorber is placed. This document proposes a recording apparatus having amount-of-waste-liquid summing means for summing to calculate the amount of ink ejected to an ink absorber. This document also proposes amount-of-waste-liquid summing means for summing predetermined values instead of the amount of ejected ink.

This document further proposes amount-of-waste-ink measuring means for dividing the size of a recording medium into segments in the direction of movement of a carriage (in the main scanning direction), determining the size of a dot count window, performing a dot count on each dot count window on a print buffer provided in a control circuit of the inkjet recording apparatus, thereby measuring the amount of ink in a borderless area.

To calculate the total amount of ink ejected to the ink absorber, the above-described known techniques require accurate measurement of the width of a recording medium and the size of overflow areas on the left and right sides of the recording medium, and calculation every time a recording operation is performed. Therefore, these known techniques require complex and expensive sensors and mechanisms for accurate detection and measurement of the width of a recording medium and the size of overflow areas. However, if a method for summing predetermined values is used instead to reduce the costs involved in producing the recording apparatus, accuracy in estimating the amount of waste liquid is degraded.

In another method proposed to avoid such problems, the amount of ink ejected to the ink absorber is not calculated by summing, but is estimated based on recording data (that is, data to be used for recording) stored in the print buffer. However, the method for estimating the amount of ink based on recording data in the print buffer has a problem in that sufficient accuracy cannot be maintained in some cases, depending on the size of the recording medium.

This problem will be described in detail.

The above-described Japanese Patent Laid-Open No. 2001-301201 discloses a structure in which control means creates bitmap data based on recording data transmitted from the host computer, and causes head drive means to generate driving signals based on the bitmap data. This document also discloses an apparatus supplying driving signals to a recording head on a carriage, allowing ink to be ejected through the recording head, thereby recording images on a recording medium.

During image recording, print control means sends control signals to amount-of-waste-liquid counting means. Thus, during full-surface recording, the number of ink droplets ejected to the waste ink absorber on the platen is counted. Such a structure for counting the number of ejected ink droplets requires an extremely complex and expensive control device, as the total number of ejected ink droplets must be counted at every ejection.

The above-described Japanese Patent Laid-Open No. 2001-301201 also proposes a recording apparatus for adding a predetermined value, instead of performing complex control, every scan of a carriage or every time recording is performed on a recording medium. Since the sum of predetermined values is calculated, this recording apparatus does not require a complex control mechanism, as there is no need to count the number of ejected ink droplets. However, since the same value regardless of the image to be recorded is added, the accuracy in the calculation of the amount of waste ink is low. This particularly poses a problem when the platen absorber is independently structured and cannot allow ink to be discharged therefrom.

For example, if a predetermined value to be added is set to be large, it is determined that the maximum amount of ink that can be absorbed in the absorber has been reached at a stage earlier than the number of recording media on which full-surface recording can actually be performed is reached. In this case, even if the absorber is actually capable of absorbing more ink, the recording operation is restricted so that full-surface recording can no longer be performed. On the other hand, if a predetermined value to be added is set to be small, and if images causing a large number of ink droplets to be ejected to the absorber are continuously recorded, ink may overflow from an absorber before a set value is reached. In this case, the amount of ink actually discharged is larger than the sum of the predetermined values. A problem thus arises in that the platen and the reverse side of the recording medium are contaminated with ink.

A method for estimating the amount of ink based on recording data stored in the print buffer is provided to solve the problems described above. However, accuracy in dot count for estimating the amount of ink ejected off the recording medium is significantly degraded, depending on the size of recording. The degradation in accuracy will be described in detailed in an embodiment below.

SUMMARY OF THE INVENTION

The present invention is directed to a recording apparatus and a waste-ink estimating method by which the amount of ink ejected to an ink absorber during full-surface recording can be estimated with a simple structure, high accuracy, and at a low cost.

In one aspect of the present invention, a recording apparatus has the following structure.

The recording apparatus of the present invention ejects ink through a recording head while causing the recording head to scan a recording medium, and is capable of performing full-surface recording that involves recording on the entire surface of the recording medium by ejecting ink to an area extending off the recording medium. The recording apparatus includes a print buffer configured to store recording data in relationship to a scanning direction of the recording head, the recording data being inputted from an external device; a counting unit dividing the print buffer into a plurality of segments and counting, on a segment-by-segment basis, the amount of recording data used by the recording head to perform a recording operation; a selecting unit comparing the recording medium to the print buffer with respect to the scanning direction of the recording head and, from the plurality of segments, selecting segments not corresponding to the inside of the recording medium; a calculating unit counting the amount of recording data included in the segments selected by the selecting unit and causing a recording operation to occur, and calculating the cumulative amount of the recording data; and an estimating unit estimating, based on the cumulative amount calculated by the calculating unit, the amount of waste ink ejected from the recording head to the outside of the recording medium in the full-surface recording.

In one embodiment, the recording apparatus includes a waste ink absorber configured to absorb the waste ink ejected outside the recording medium in the full-surface recording.

In one embodiment, the selecting unit selects the segments not corresponding to the inside of the recording medium according to the size of the recording medium in the scanning direction of the recording head and a number of bits of recording data expressing a pixel recorded by the recording head.

In one embodiment, the selecting unit selects the segments in consideration of a recording resolution of the recording head.

In one embodiment, the recording apparatus includes an accumulating unit accumulating the amount of waste ink ejected from the recording head to the outside of the recording medium, the amount being estimated by the estimating unit, and that the accumulating unit includes a nonvolatile memory for storing the accumulated amount of waste ink.

In one embodiment, the recording apparatus includes a comparing unit comparing the accumulated amount of waste ink with a predetermined threshold, the accumulated amount being stored in the nonvolatile memory; and a recording control unit controlling subsequent recording operations according to the comparison performed by the comparing unit.

According to another aspect of the present invention, a waste-ink estimating method estimates the amount of waste ink during full-surface recording in a recording apparatus. The recording apparatus ejects ink through a recording head while causing the recording head to scan a recording medium, and is capable of performing the full-surface recording involving recording on the entire surface of the recording medium by ejecting ink to an area extending off the recording medium. The waste-ink estimating method includes counting step of dividing a print buffer into a plurality of segments and counting, on a segment-by-segment basis, the amount of recording data causing the recording head to perform a recording operation, the print buffer being provided for storing recording data in relationship to a scanning direction of the recording head, the recording data being inputted from an external device; a selecting step of comparing the recording medium to the print buffer with respect to the scanning direction of the recording head and, from the plurality of segments, selecting segments not corresponding to the inside of the recording medium; a calculating step of counting the amount of recording data included in the segments selected in the selecting step and causing a recording operation to occur, and calculating the cumulative amount of the recording data; and an estimating step of estimating, based on the cumulative amount calculated in the calculating step, the amount of waste ink ejected from the recording head to the outside of the recording medium in the full-surface recording.

According to the present invention, a print buffer for storing recording data is divided into a plurality of segments, and the amount of recording data causing a recording head to perform a recording operation is counted on a segment-by-segment basis. A recording medium is compared to the print buffer with respect to a scanning direction of the recording head and segments not corresponding to the inside of the recording medium are selected from the plurality of segments. Then, the amount of recording data included in the selected segments and causing a recording operation to occur is counted and added up. Thus, without requiring special mechanisms, the amount of ink ejected outside the recording medium in full-surface recording can be accurately estimated according to the size of the recording medium, with a simple structure that involves data processing in the print buffer.

Further features of the present invention will become apparent from the following description of exemplary embodiments with reference to the attached drawings.

BRIEF DESCRIPTION OF THE DRAWINGS

FIG. 7 shows the calculations of dot count accuracy.

FIG. 10 shows the calculations of dot count accuracy according to the first embodiment of the present invention.

FIG. 12 shows the calculations of dot count accuracy according to the second embodiment of the present invention.

DESCRIPTION OF THE EMBODIMENTS

Embodiments of the present invention will now be described in detail with reference to the attached drawings.

In this specification, the term "recording" (may also be referred to as "printing") not only represents the formation of text and graphics that have meanings or are visible to human eye, but also represents in a broader sense the formation of images and patterns on a medium, and further, the processing of a medium.

The term "recording medium" not only represents paper that is used in typical recording apparatuses, but also represents media, such as cloth, plastic films, metal plates, glass, ceramic, wood, and leather, that can accept ink.

The term "ink" (may also be referred to as "liquid") has a broad range of meaning similarly to "recording (printing)" described above. That is, the term "ink" in this specification represents liquid to be used for forming images and patterns on a recording medium, processing of a recording medium, or ink processing. Examples of ink processing include coagulating or insolubilizing coloring materials contained in ink to be applied to a recording medium.

Unless otherwise specified, the term "nozzle" collectively represents an ejection outlet, a liquid channel communicating with the ejection outlet, and devices generating energy to be used for the ejection of ink.

The term "full-surface recording" means a recording operation performed on the entire surface of a recording medium without leaving a blank space on the edge of the medium. In full-surface recording, an area located outside the recording medium and to which ink is ejected is called "overflow area" or "borderless area".

Before describing the embodiments of the present invention, the basic structure of an inkjet recording apparatus to which the present invention is applicable will be described as an example with reference to FIG. 1 to FIG. 3.

Figure 1:
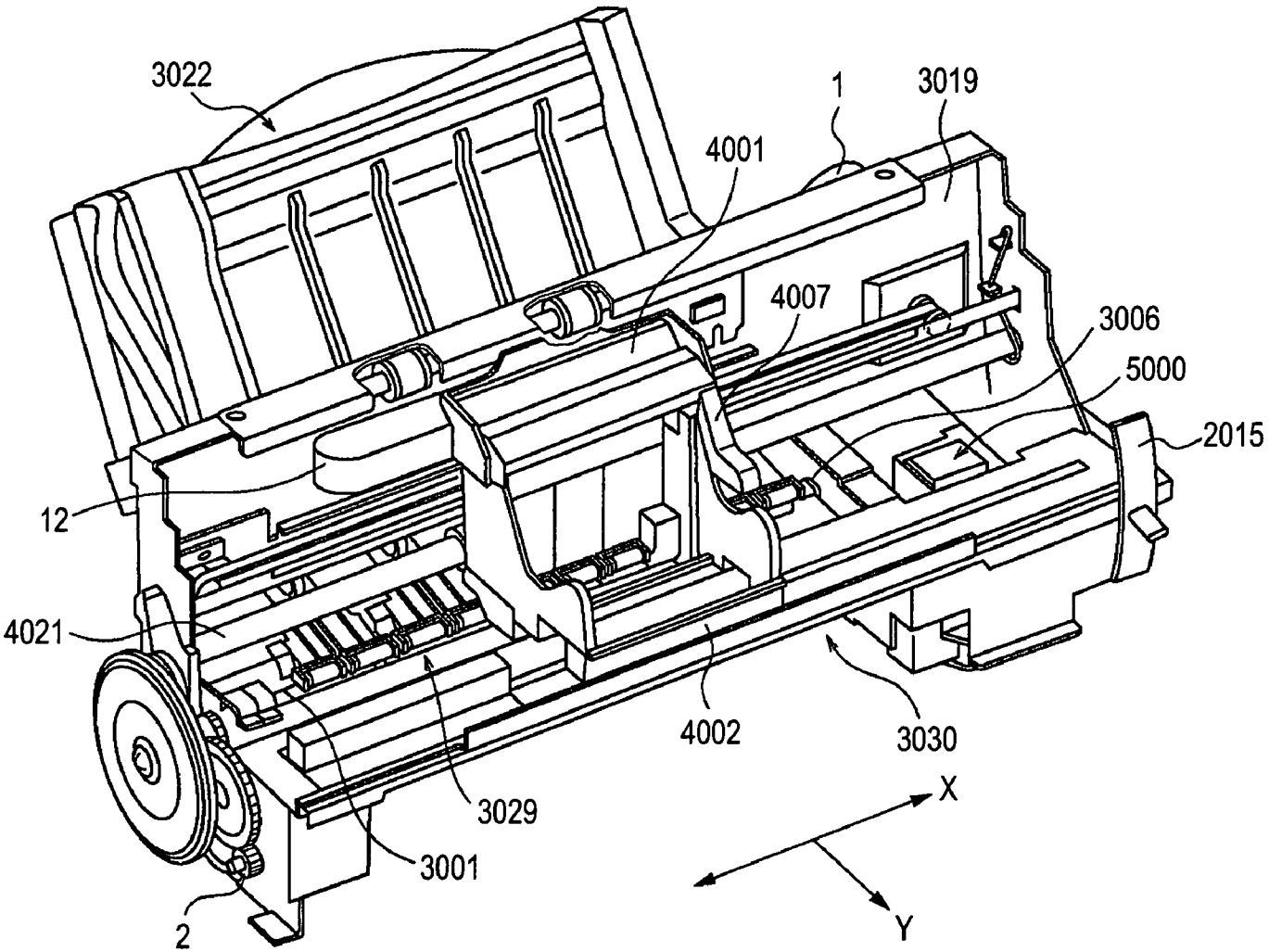
FIG. 1 is an external perspective view showing the overall structure of an inkjet recording apparatus by which the present invention can be implemented.

FIG. 1 shows the structure of a main part of an inkjet recording apparatus (hereinafter called recording apparatus) which is a typical embodiment of the present invention.

Figure 2:
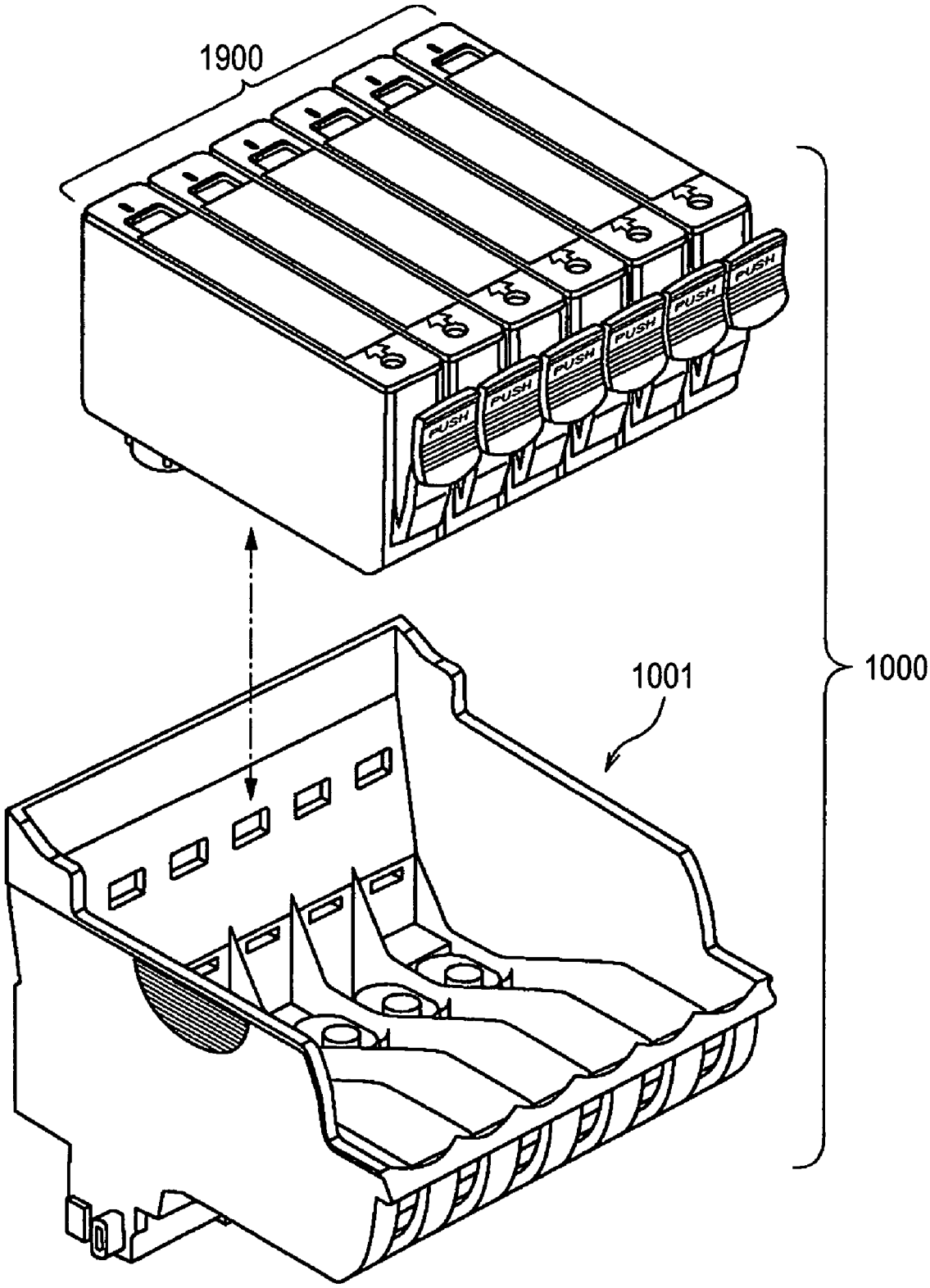
FIG. 2 is a perspective view of a recording head with ink tanks.

FIG. 2 is a perspective view of a recording head with ink tanks.

Referring to FIG. 1, a chassis 3019 housed in an outer member of the recording apparatus is made of a plurality of metal plates having a predetermined rigidity, constitutes the frame of the recording apparatus, and holds mechanisms for recording operations described below.

An automatic feeder 3022 automatically feeds paper (recording medium) into the recording apparatus. A carrier 3029 leads each sheet of paper supplied from the automatic feeder 3022 to a predetermined recording position and further, from that position, to a paper ejection outlet 3030. An arrow Y indicates a transport direction (sub-scanning direction) of a sheet. A recording unit performs recording, as desired, on the sheet brought to the recording position. A recovery unit 5000 performs recovery processing on the recording unit. A gap adjusting lever 2015 and a bearing 3006 of an LF roller 3001 are also provided.

In the recording unit, a carriage shaft 4021 supports a carriage 4001 movably in a carriage movement direction (main scanning direction) indicated by an arrow X. FIG. 2 shows an inkjet recording head (hereinafter called recording head) 1001 capable of ejecting ink, and an ink tank unit 1900 attached to the recording head 1001. The recording head 1001 in FIG. 2 is removably attached to the carriage 4001 in FIG. 1. As shown in FIG. 2, the recording head 1001 and the ink tank unit 1900 for storing ink constitute a head cartridge 1000. The ink tank unit 1900 includes individual ink tanks for each color. In the embodiments, six ink tanks corresponding to black, light cyan, light magenta, cyan, magenta, and yellow are provided to achieve photographic quality color recording. Each ink tank of the ink tank unit 1900 is removably attached to the recording head 1001.

The recording head 1001 receives, from a main substrate 1 via a flexible cable 12, head drive signals required for a recording operation. It is desired that thermal energy generated by an electrothermal converter be used as energy for ejecting ink. Heat generated by the electrothermal converter causes film boiling of ink to take place. Discharge energy associated with the film boiling allows ink to be ejected from ink ejection outlets.

The recovery unit 5000 in FIG. 1 is provided with a cap (not shown) for covering openings of the ink ejection outlets. According to a known structure, a suction pump for introducing a negative pressure into the cap is attached to the cap to perform suction recovery processing. The present invention may provide a structure that can accommodate the suction recovery processing. The suction recovery processing is recovery processing performed for the recording head 1001 to maintain good ink ejection conditions. In this processing, a suction pump is driven to develop a negative pressure in the cap covering the ink ejection outlets of the recording head 1001, thereby sucking ink out of the ink ejection outlets. The present invention may also have a structure that can accommodate ejection recovery processing, as well as the suction recovery processing, to maintain good ink ejection conditions through ejection. In this ejection recovery processing, ink that does not contribute to the recording of images is ejected from the ink ejection outlets toward the inside of the cap.

The carriage 4001 is provided with a carriage cover 4002. The carriage 4001 is also provided with a lever 4007 for positioning the recording head 1001 at a predetermined fixing point.

A platen (not shown) is disposed at a position for recording performed by the recording head 1001. The platen is provided with a platen absorber (not shown) extending along the scanning direction of the carriage 4001 and facing the ink ejection outlets of the recording head 1001. As described above, the platen absorber absorbs ink droplets ejected outside a recording medium during recording on the entire surface of the recording medium. The platen absorber is arranged so as to be located below the recording medium fed to the recording position in the recording apparatus. Thus, the recording medium is placed between the recording head 1001 and the platen absorber.

Figure 3:
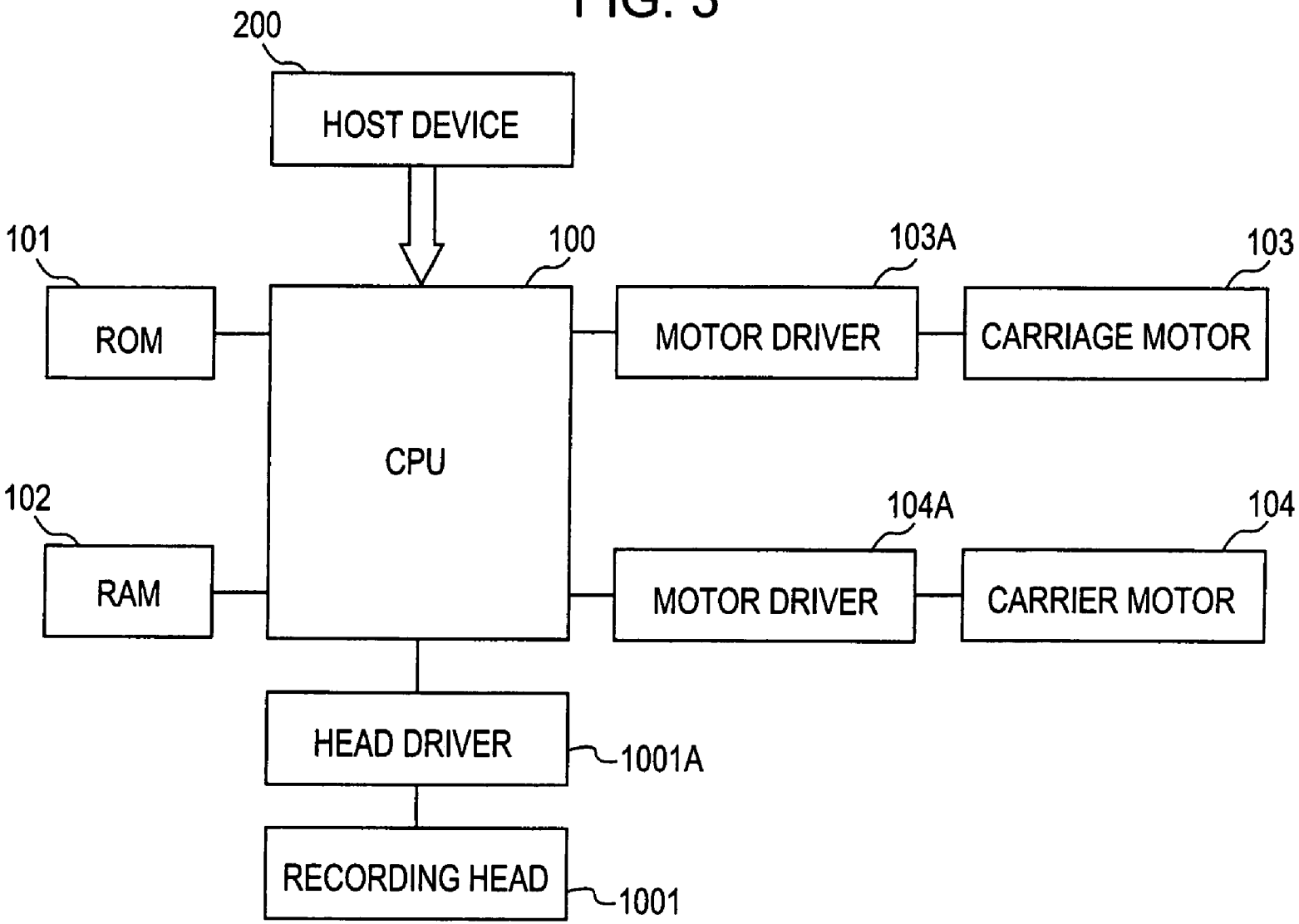
FIG. 3 is a block diagram showing the control structure of the inkjet recording apparatus in FIG. 1.

FIG. 3 is a block diagram showing the overall structure of a control circuit of the recording apparatus in FIG. 1.

Referring to FIG. 3, a central processing unit (CPU) 100 executes control processing and data processing for the operation of the recording apparatus. A read-only memory (ROM) 101 stores programs of procedures for these processing operations. The random-access memory (RAM) 102 provides a work area for these processing operations to be executed. The CPU 100 supplies drive data (recording data) and drive control signals (heat pulse signals) for the electrothermal converter to a head driver 1001A, thereby allowing ink to be ejected from the recording head 1001. The CPU 100 controls, via a motor driver 103A, a carriage motor 103 for driving the carriage 4001 in the main scanning direction. The CPU 100 also controls, via a motor driver 104A, a carrier motor 104 for transporting paper (recording medium) in the sub-scanning direction.

A host device 200 (hereinafter referred to as host) is connected to external devices outside the recording apparatus. The recording apparatus receives data transmitted from the host 200 to execute processing for recording, and performs a print operation.

To perform a recording operation by the recording apparatus with the structure described above, recording data transmitted from the host 200 via an external interface (I/F) (not shown) is temporarily stored in a print buffer. Then, in a recording operation, the carriage motor 103 causes the carriage 4001 and the recording head 1001 to move in the main scanning direction during ink ejection from the recording head 1001 based on recording data, while, in a transport operation, the carrier motor 104 causes paper (recording medium) to be transported by a predetermined distance in the sub-scanning direction. The repetition of the recording operation and the transport operation allows sequential image recording on the paper (recording medium).

First Embodiment

Full-surface recording using the recording apparatus having the above-described structure will now be described.

Before explaining the first embodiment, a dot count method commonly used for full-surface recording will be described in detail, for comparison with the present embodiment, with reference to FIG. 4 and FIG. 5.

After recording data is transferred from the host 200 to the print buffer of the recording apparatus, the recording apparatus of the present embodiment extracts, from the print buffer, recording data for each scan of the carriage, transfers the extracted recording data to the recording head, and performs image recording. The amount of ink ejected outside the recording medium in full-surface recording is estimated not by measuring the number of ink droplets ejected from the recording head, but by obtaining the amount of image data in a region of the print buffer, the region corresponding to an area extending off the recording medium. The amount of image data can be obtained by counting or calculating the amount of data.

The method for estimation will be described in sequence.

Figure 4:
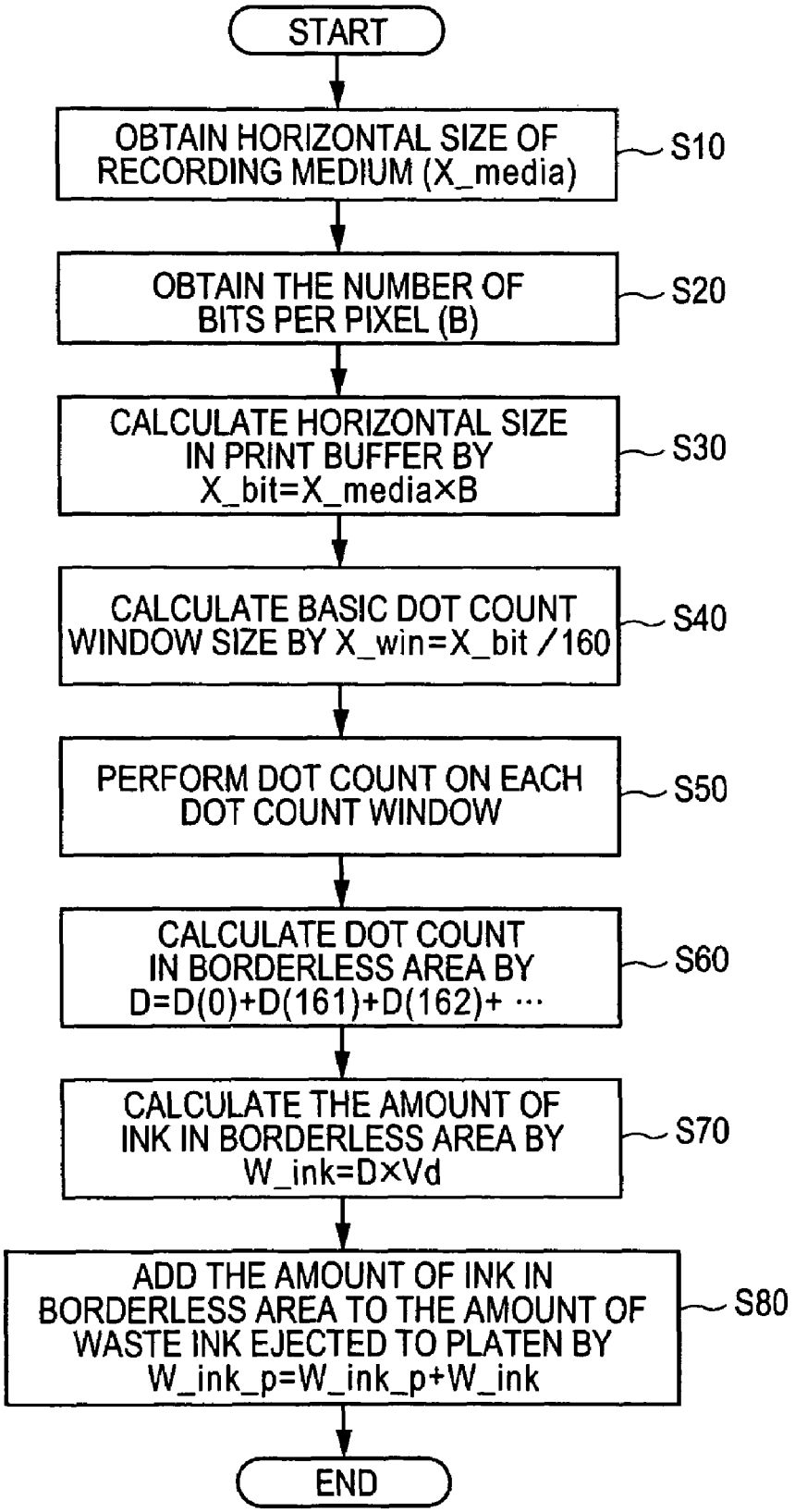
FIG. 4 is a flowchart showing a typical dot count method.

FIG. 4 is a flowchart showing a method for estimating the amount of ink ejected outside the recording medium in full-surface recording.

After expanding recording images (images to be recorded) in the print buffer, the horizontal size of the recording medium (X_media) is obtained in step S10. The horizontal size corresponds to the width of the recording medium, and represents the size or length of the recording medium in the main scanning direction. In the present embodiment, the horizontal size (X_media) is not measured in length, but is expressed as the number of pixels.

Next, the number of bits per pixel (B) is obtained in step S20.

In the present embodiment, four bits of image data per pixel at a 600-dpi resolution are transmitted from the host 200. The horizontal size in the print buffer (X_bit) can be calculated by X_bit=X_media×B in step S30. The number of data bits corresponding to the size of the recording medium along the main scanning direction can thus be determined.

If the horizontal size of the recording medium obtained in step S10 is measured in length, the number of pixels corresponding to the horizontal size can be determined according to the resolution. The number of data bits corresponding to the horizontal size can be obtained by multiplying the number of bits per pixel (B) by the resultant number of pixels.

Next, the basic dot-count window size on which a dot count is to be performed is determined.

The size of a dot count window in the sub-scanning direction is given a fixed value, such as "16". In the present embodiment, the number of dot count windows is fixed at 160. Therefore, in step S40, the basic dot-count window size (X_win) in the main scanning direction is given by X_win=X_bit/160. In the present embodiment, the number of dot count windows is fixed at 160 to simplify processing required for managing the dot count windows. Therefore, the basic dot-count window size (X_win) varies with the horizontal size of the recording medium.

If the horizontal size of a dot count window is fixed, management of the dot count windows becomes complex, as the number of dot count windows varies with the size of the recording medium. That is, if the horizontal size of a dot count window is set to be small, the number of dot count windows increases in proportion to the size of the recording medium, and thus management of the dot count windows increases in complexity. On the other hand, if the horizontal size of a dot count window is set to be large, a high degree of accuracy in dot count cannot be achieved when recording is performed on a small recording medium. Therefore, it is desired that the number of dot count windows be fixed, and the basic dot-count window size be determined according to the size of the recording medium.

In step S50, a dot count is performed on each window. Since the origin of the recording medium (described below) is fixed regardless of the size of the recording medium, an area on the left of the origin is not divided into segments and is treated as a single segment on which a dot count is to be performed.

Figure 5:
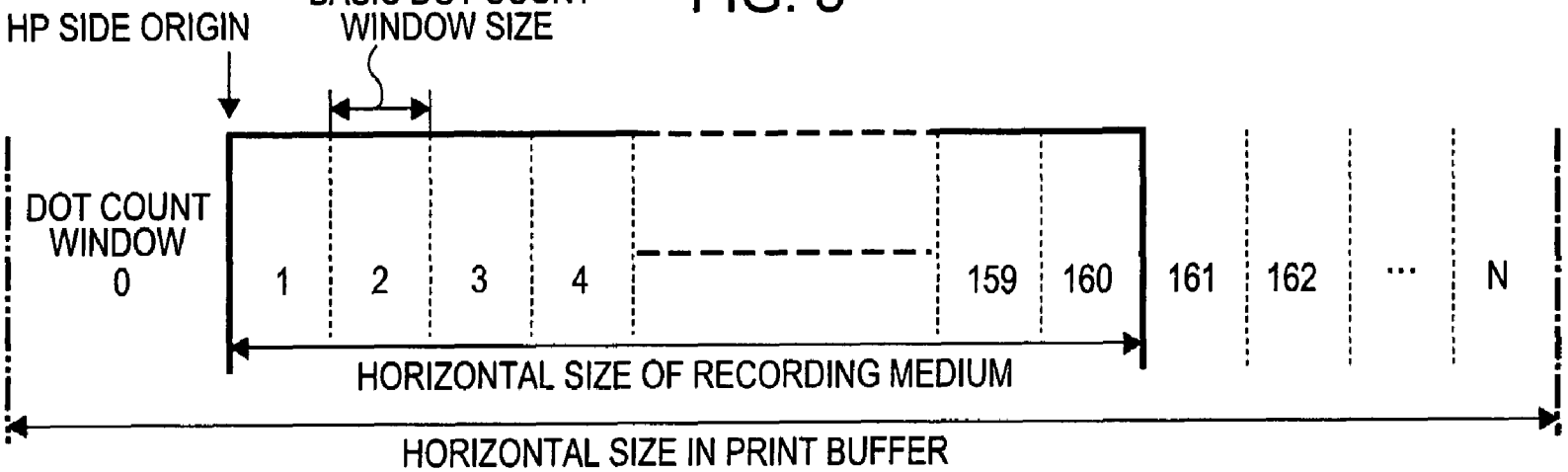
FIG. 5 is a diagram showing the relationship between the sizes of a typical print buffer, each dot count window, and a recording medium.

FIG. 5 is a diagram showing the relationship between the sizes of a print buffer, each dot count window, and recording medium. As shown, the print buffer is divided, in the main scanning direction, into (N+1) segments, each segment being a window on which a dot count is to be performed. In this recording apparatus, which can accommodate recording media of various sizes, a recording medium of any size is placed to fit in the home position (HP) of the carriage. Therefore, as shown in FIG. 5, the HP-side edge of the recording medium is defined as the origin of the recording medium.

FIG. 5 shows that, in the entire range of the print buffer, a region corresponding to the horizontal size of the recording medium corresponds to windows 1 to 160.

In FIG. 5, the recording medium is located on the right of the HP-side origin, but not on the left. Therefore, in the print buffer, a region corresponding to the left side of the origin is not divided into segments, and is treated as a single window (window "0"). That is, a region on the left of the HP-side origin is treated as a single window on which to perform a dot count.

In step S50 in FIG. 4, a dot count is performed on each window. In this process, a dot count value in the n-th window is denoted by D(n), and a dot count is performed on a window-by-window basis. As described above, the horizontal size of the recording medium is divided into 160 dot count windows. In step S60, a dot count is performed on an area extending off the recording medium and to which ink is ejected (hereinafter also referred to as borderless area). The n-th windows satisfying n=0 and n>160 are selected as the area extending off the recording medium and to which ink is ejected in full-surface recording. The sum of dot count values in these windows (D) is a count value corresponding to the area extending off the recording medium and to which ink is ejected.

In step S70, the amount of ink ejected off the recording medium (W_ink) is determined by multiplying the count value (D) obtained in step S60 by the amount of ejected ink per dot (Vd).

There is a known structure where drive control of a recording head allows varying amounts of ink to be ejected. There is also a known structure where a recording head with a plurality of ejection outlets of different diameters allows ink droplets of different sizes to be ejected. In these structures where ink droplets of different sizes are used for forming images, it is desirable that the amount of ink ejected to the area extending off the recording medium be determined by multiplying a count value (D) by the volume of each ink droplet with respect to ink droplets of different sizes. Dot count values may be weighted, according to the size of ink droplets, by volume ratios such that count values (D) proportional to the respective volumes can be obtained.

In step S80, the amount of waste ink discharged to the absorber on the platen is calculated. The amount of ink (W_ink) determined in step S70 is added to the amount of waste ink discharged to the platen (W_ink_p). The amount of waste ink discharged to the platen (W_ink_p) before the processing in step S80 is the amount of waste ink obtained in previous processing, and is updated by adding the amount of ink (W_ink) obtained in step S70 to (W_ink_p). That is, the cumulative amount of ink (W_ink_p) can be determined by adding up newly obtained (W_ink). Since, in the present embodiment, data corresponding to a single scan of the recording head is processed to obtain the amount of ink (W_ink), the amount of waste ink (W_ink_p) is updated every scan of the carriage. By temporarily storing the amount of ink (W_ink) obtained in each scan, the amount of waste ink (W_ink_p) can be updated, for example, after feeding a recording medium, at every print job, after capping the recording head on completion of recording, or when the recording apparatus is turned off.

The amount of waste ink discharged to the platen (W_ink_p) is stored in a nonvolatile memory, such as an electrically programmable read only memory (EEPROM), as it needs to be retained even when the recording apparatus is turned off. Since the EEPROM has an upper limit to the number of writes, update timing is predetermined according to the life of the recording apparatus or the frequency of recording operation. For example, for a recording apparatus with a short life, data may be written to the EEPROM at every scan of the carriage. However, for a recording apparatus with a long life, it is desirable, for reducing the number of updates, that the amount of waste ink (W_ink_p) on the platen be updated, for example, after feeding a recording medium or after capping the recording head on completion of recording.

Through the processing described above, the recording apparatus determines whether or not the amount of waste ink discharged to the platen (W_ink_p) exceeds a certain level. If it is determined that a certain level has exceeded, the recording apparatus calls the user's attention by transmitting a signal indicating its status to the host, through which a warning message is displayed to the user. In the structure where the host receives information indicating the status of the recording apparatus, the host can receive information about the amount of waste ink discharged to the platen (W_ink_p) or information indicating that the amount of waste ink discharged to the platen (W_ink_p) has exceeded a certain level, and display a warning message to the user as described above. The host may perform control for prohibiting the recording operation instead of displaying a warning message. Such control prevents an increased amount of ink in the absorber on the platen from causing the recording medium to be contaminated.

Compared to the known structure where a predetermined value is added every time a recording operation on a recording medium is performed, the above-described control improves accuracy in dot count performed on an area outside the recording medium.

With the structure described above, the amount of ink ejected to an area extending off the recording medium can be determined with a higher degree of accuracy than that achieved by the known structure.

However, since fractions are dropped in calculations performed in the recording apparatus, the above-described method may cause errors depending on the size of the recording medium. In particular, if the platen absorber is independently structured and cannot allow ink to be discharged therefrom, the amount of waste ink that can be absorbed the platen absorber is small. Therefore, it is highly likely that the amount of waste ink discharged to the platen absorber will exceed a specified value and a recording operation will be disabled before the life of the recording apparatus ends.

Reasons for such errors to occur will now be described with reference to FIG. 6 and FIG. 7.

Figure 6:
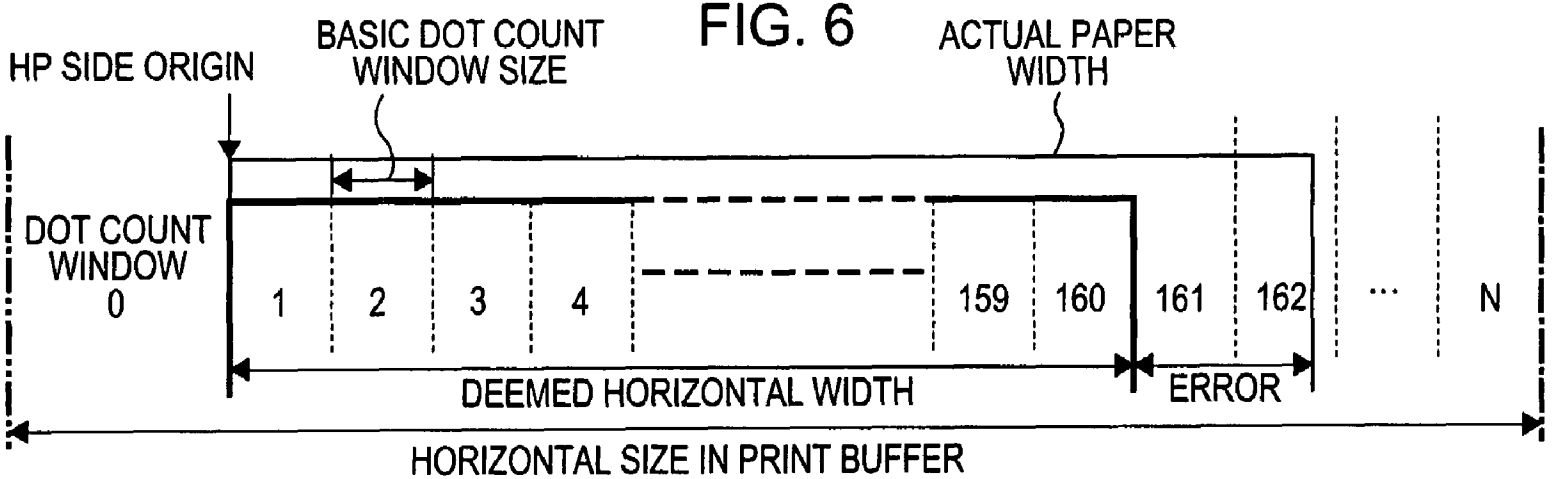
FIG. 6 is a diagram for explaining errors in dot count.

FIG. 6 is a diagram showing the relationship between the sizes of a print buffer, each dot count window, and recording medium.

FIG. 7 shows the relationship between the size of the recording medium and errors in dot count.

An L-size recording medium and four bits of image data per pixel are taken as an example. When the pixel resolution is 600 dpi, the horizontal size of the recording medium is 2103 pixels. Thus, the horizontal size in the print buffer is 8412 bits, as the number of bits per pixel is four. If recording of one dot is under the control of one bit of data, the horizontal size of the recording medium is equivalent to 8412 dots.

The basic dot-count window size (X_win) is given by 8416/160=52.575 according to step S40 in FIG. 4. Since the digits to the right of the decimal point are discarded in calculations performed in the recording apparatus, the basic dot-count window size (X_win) when recording is performed on an L-size recording medium is 52, as shown in "1 window" column in FIG. 7.

If a size 160 times the basic dot-count window size is considered to be the horizontal width of the recording medium (hereinafter referred to as a deemed horizontal width), the sum of the sizes of a dot count window 0 and dot count windows 161 and above are calculated as the size of the borderless area. However, as shown in FIG. 6, the actual paper size is equivalent to the total size of the dot count windows 1 to 162. That is, since the basic dot-count window size X_win=52 is given by truncating the digits after the decimal point, a large error is produced between the actual paper size and the width 160 times the basic dot-count window size. The amount of this large error is equivalent to 160 times the amount corresponding to the discarded digits to the right of the decimal point. In consideration of the fractional portion discarded, it is desirable, for reducing such an error, that the sum of the sizes of the dot count window 0 and dot count windows 163 and above be calculated as the size of the borderless area.

As shown in an "X-X'" column in FIG. 7, for an L-size recording medium, the amount of the error caused by the truncation of the fractional portion is equivalent to a width of 92 dots according to calculation. The width measures 0.97 mm in the main scanning direction. The amount of the error is equivalent to the size of 1.77 dot count windows, as the size of a dot count window is 52 dots. If the size of the area extending off the recording medium and to which ink is ejected (the size of the borderless area) is 2 mm (equivalent to 47.2 dots at a resolution of 600 dpi), the ratio of the dot count value in the overflow area to that in the actual overflow area is given by (2+0.97) mm/2 mm=148%. In other words, the number of dots that is about 1.5 times the dot count value in the actual overflow area is counted.

The ratio varies depending on the size of the recording medium. As shown in FIG. 7, while the ratio is 1.0 for a 4 inch by 6 inch recording medium, the ratio is 1.8 for a card-size recording medium. Thus, the ratio varies widely depending on the size of the recording medium. An increased amount of error in the dot count value of the borderless area affects accuracy in managing the amount of ink discharged onto the platen.

Based on the considerations described above, the present embodiment provides a simple and inexpensive dot count method that can improve accuracy in dot count values in the area extending off the left and right edges of the recording medium.

A typical dot count method of the present embodiment will now be described in detail with reference to FIG. 8 and FIG. 9.

Figure 8:
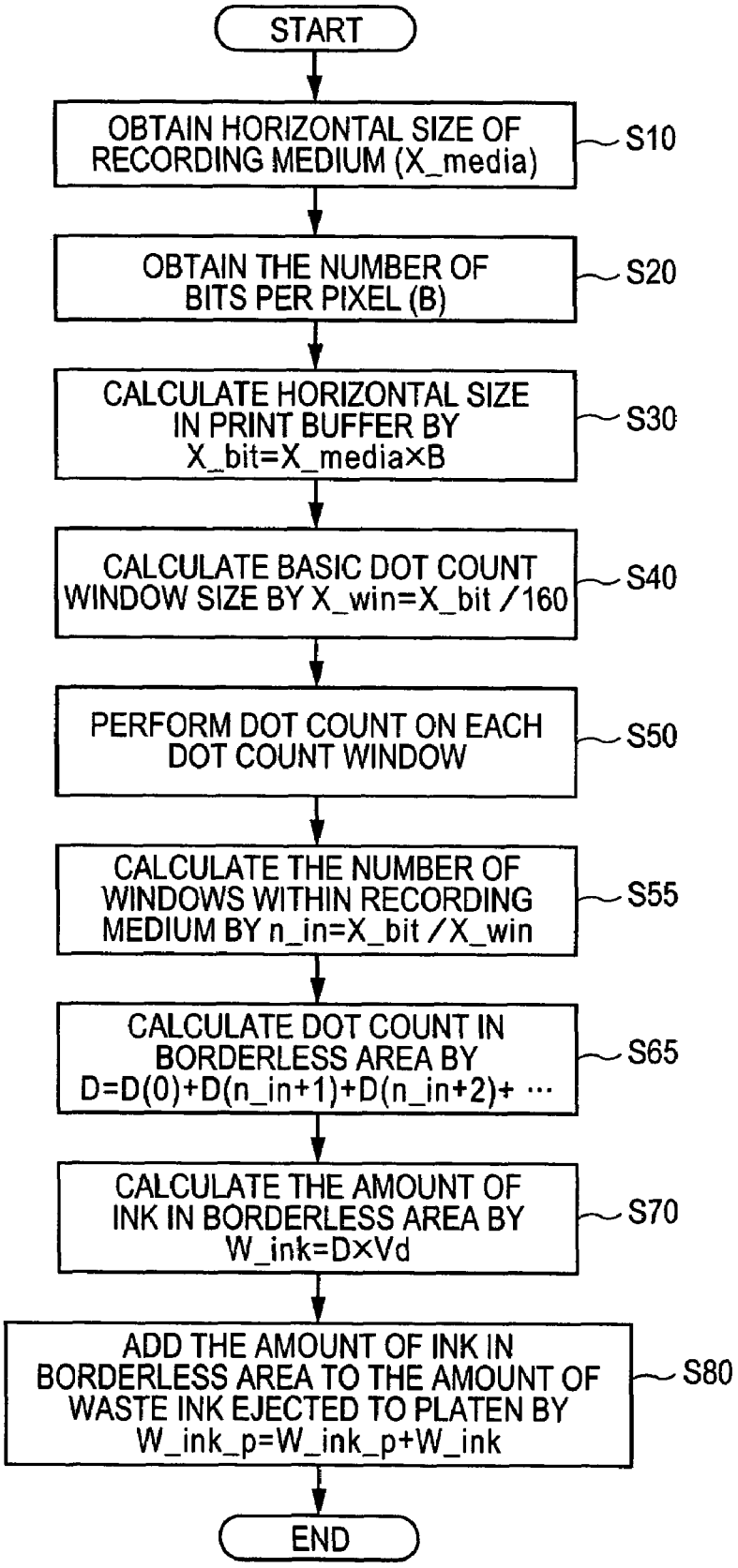
FIG. 8 is a flowchart showing a dot count method according to a first embodiment of the present invention.

FIG. 8 is a flowchart showing a method for estimating the amount of ink ejected to the overflow area according to the first embodiment of the present invention. The steps already described with reference to FIG. 4 are given the same reference numerals and their description will be omitted here.

In step S10 to step S50, the horizontal size in the print buffer is calculated, the basic dot-count window size is determined, and a dot count is performed on each dot count window according to the typical method in FIG. 4.

In step S55, the number of dot count windows corresponding to the inside of the recording medium (n_in) is determined based on the horizontal size in the print buffer (X_bit) and the basic dot-count window size (X_win). In step S65, the sum of dot count values in the n-th windows satisfying n=0 and n>n_in is calculated to determine the dot count value in the borderless area (D).

Figure 9:
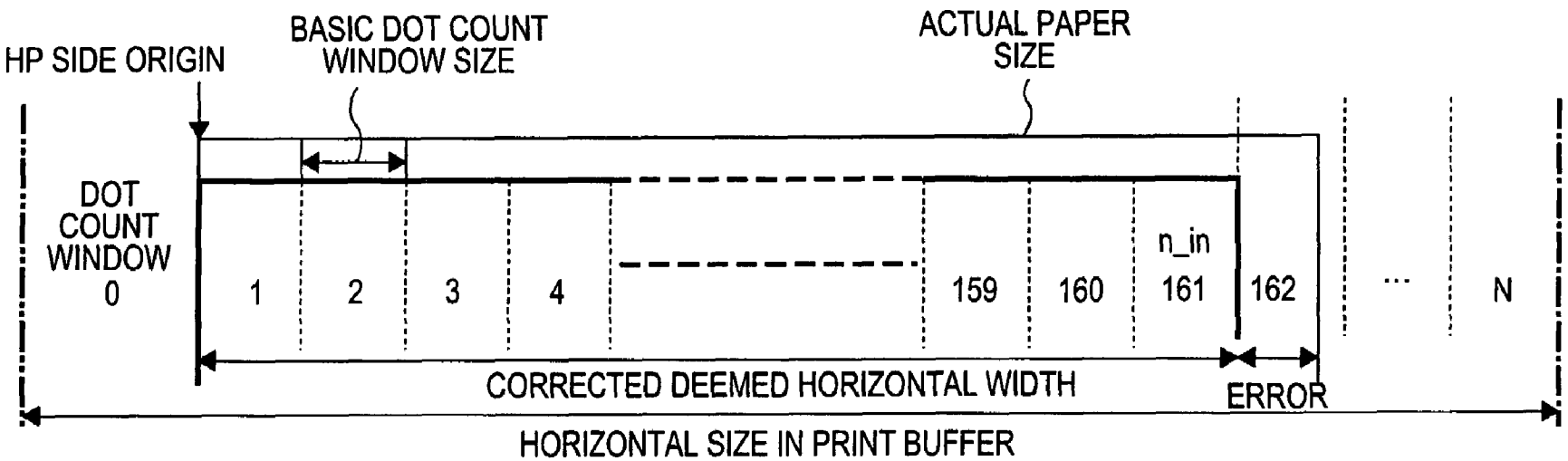
FIG. 9 is diagram for explaining errors in dot count according to the first embodiment of the present invention.

FIG. 9 is a diagram showing the relationship between the sizes of the print buffer, each dot count window, and recording medium. The number of dot count windows corresponding to the inside of the recording medium n_in = 161 is given in FIG. 9. As is obvious from the comparison with FIG. 6, the amount of error with respect to the actual size of the recording medium is less than the size of a dot count window.

In step S70 and step S80, the amount of ink in the borderless area (W_ink) is determined and the amount of waste ink discharged onto the platen (W_ink_p) is updated, according to the typical method described in FIG. 4.

An improvement in accuracy in dot count performed on the overflow area according to the present embodiment will now be described with reference to FIG. 10.

FIG. 10 shows the relationship between the size of the recording medium and errors in dot count according to the present embodiment. As is obvious from the comparison with FIG. 7, values in the right-end column of the table differ from those appearing in the right-end column of the table in FIG. 7. That is, the closer the value is to 100%, the smaller the amount of error. The amount of error shown in FIG. 10 is smaller than that shown in FIG. 7.

For comparison with the method described above, the size of the recording medium and the number of bits per pixel are the same as those in the example described above. That is, an L-size recording medium and four bits of image data per pixel are taken as an example. The basic dot-count window size (X_win) when recording is performed on an L-size recording medium is also 52.

Here, the number of dot count windows corresponding to the inside of the recording medium (n_in) is determined by dividing the horizontal size in the print buffer (X_bit) by the basic dot-count window size (X_win). Thus, n_in=161 is given by 8412/52=161.

Based on this calculation, a dot count value in the overflow area (D) extending off the recording medium and to which ink is ejected can be determined by summing dot count values in the n-th windows satisfying n=0 and n>n_in (=161). Therefore, the dot count value in the area corresponding to the inside of the recording medium is given by 161×52=8372. On the other hand, since the number of bits in the print buffer is 8412, the difference (X−X') is given by 8412−8372=40. Since the number of bits per pixel is specified as four, this difference can be converted to the number of pixels by calculating 40/4=10 (pixels), which can further be converted to a length by calculating 25.4×10/600=0.42 (mm) in consideration of a resolution of 600 dpi.

If the size of the overflow area is 2 mm (equivalent to 47.2 dots at a resolution of 600 dpi), the ratio of the dot count value in the overflow area to that in the actual overflow area is given by (2 mm+0.42 mm)/2=121%. Compared to a ratio of 148% shown in FIG. 7, the error in dot count can be reduced by about 27%.

In full-surface recording, the ratio ranges from 1.0 to 1.2 times in FIG. 10 while the ratio ranges from 1.0 to 1.8 times in FIG. 7. Although the effect varies with the size of the recording medium, it is obvious that the accuracy is improved.

Then, the total amount of waste ink calculated by the above-described method is compared with a predetermined threshold (for example, the amount of ink that can be absorbed in the platen absorber, or the upper limit that prevents ink from overflowing from the absorber). If the total estimated amount of waste ink has exceeded the threshold, the CPU executes control such that no further full-surface recording or recording operation is performed.

In the present embodiment, as described above, the print buffer in the recording apparatus is divided into small windows, and a dot count is performed on each window to estimate the amount of waste ink ejected to the overflow area in full-surface recording. Specifically, the horizontal size of a dot count window is calculated based on the horizontal size (in the main scanning direction) of the recording medium. Then, the number of dot count windows (n_in) corresponding to the inside of the recording medium is calculated based on the calculated horizontal size of a dot count window and the horizontal size of the recording medium. Some of the dot count windows that are not included in the number (n_in) are selected as a borderless area, and the sum of the dot count values in the borderless area are calculated as the amount of waste ink. Thus, the present embodiment achieves improved accuracy in managing the amount of waste ink with a less complex and less expensive structure compared to the known structures.

Although, in the present embodiment, the number of dot count windows is determined by dividing the horizontal size in the print buffer (in the main scanning direction) by the basic dot-count window size, the number of the dot count windows corresponding to an error may be obtained by determining a deemed horizontal width (X') by X'=X_win×160 based on the basic dot-count window size, and dividing the error (X−X') by the basic dot-count window size.

Second Embodiment

The second embodiment of the present invention will now be described in detail with reference to FIG. 11 and FIG. 12.

Figure 11:
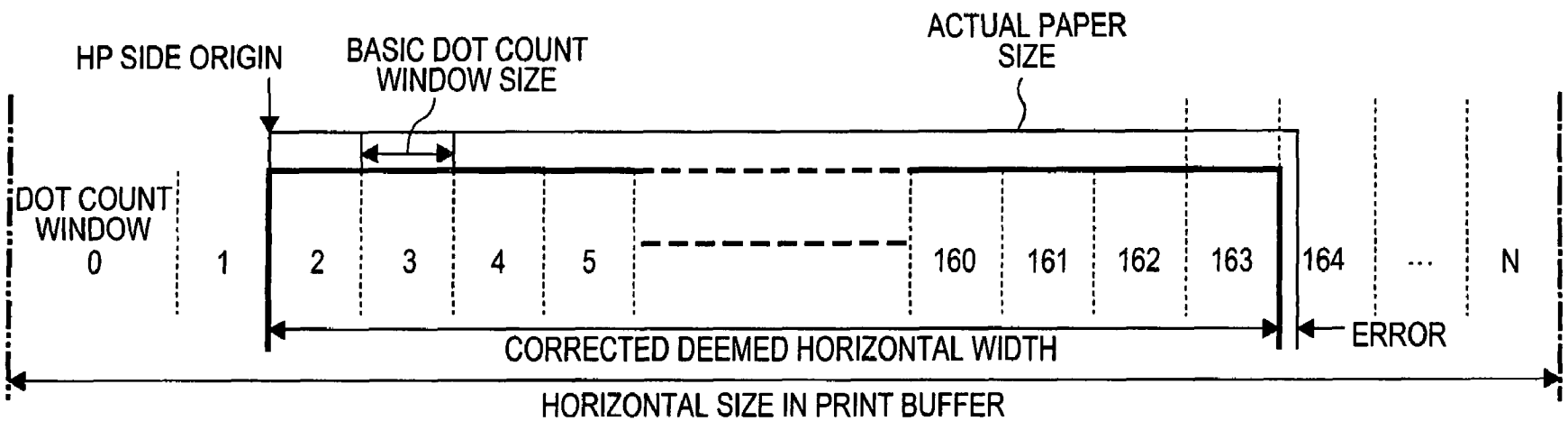
FIG. 11 is diagram for explaining errors in dot count according to a second embodiment of the present invention.

FIG. 11 is a diagram showing the relationship between the sizes of a print buffer, each dot count window, and recording medium. In the present embodiment, each pixel is expressed by eight bits of image data.

FIG. 12 shows the relationship between the size of the recording medium and errors in dot count.

There is a case where an overflow area outside the HP-side origin cannot fit in a single dot count window due to a limit on the horizontal size of a dot count window and a large number of bits per pixel. In such a case, as shown in FIG. 11, dot count windows 0 and 1 are assigned to the overflow area outside the HP-side origin.

Then, the amount of waste ink in the borderless area is estimated similarly to the first embodiment.

A card-size recording medium (horizontal width is 54 mm) and eight bits of image data per pixel are taken as an example. The horizontal size of a card (in the main scanning direction) is 1276 dots at a resolution of 600 dpi, while the size in the print buffer (X_bit) is 10208 bits. A basic dot-count window size (X_win) is given by 10208/160=63.8 (bits). Since the digits to the right of the decimal point are discarded in calculations performed in the recording apparatus, the basic dot-count window size (X_win) is 63.

The number of dot count windows (n_in) corresponding to the inside of the recording medium is determined by dividing the horizontal size in the print buffer (in the main scanning direction) (X_bit) by the basic dot-count window size (X_win), that is, 10208/63=162. In the present embodiment, as shown in FIG. 11, dot count windows 0 and 1 are assigned to the overflow area outside the HP-side origin. Therefore, a dot count for the overflow area is performed on windows n satisfying n=0 and 1 and n>n_in (=1+162). The sum of dot count values in these windows is a value corresponding to the overflow area. Thus, a corrected dot count value in the overflow area is given by 162×63=10206, and the difference with the number of bits in the print buffer (X−X') is given by 10208−10206=2. Since the number of bits per pixel is specified as eight, this difference can be converted to the number of pixels by calculating 2/8=0.25 (pixels), which can further be converted to a length by calculating 25.4×0.25/600=0.010 (mm) in consideration of a resolution of 600 dpi.

If the size of the overflow area is 2 mm (equivalent to 47.2 dots at a resolution of 600 dpi), the ratio of the dot count value in the overflow area to that in the actual overflow area is given by (2 mm+0.010 mm)/2=100.5%. Referring to FIG. 12, in the known method, dots of about 133% of the correct value are counted due to about two windows of errors. In the present embodiment, the error in dot count can be reduced by about 33%.

According to the present embodiment described above, even if there is a limit on the horizontal size of a dot count window and the number of bits per pixel is large, accuracy in managing the amount of waste ink in the overflow area can be improved with a less expensive and less complex structure, compared to the known structure, by assigning a plurality of dot count windows to the overflow area outside the HP-side origin to perform a dot count in the overflow area.

As is obvious from the present embodiment, errors in dot count in the overflow area vary greatly with the size of the recording medium or the number of bits of image data per pixel. Therefore, the present embodiment may be applied only to cases where the size of the recording medium is small or the number of bits of image data per pixel is large.

In the present embodiment described above, the ink absorber on the platen is independently structured. However, even if the ink absorber on the platen is integrated with a main waste-ink absorber in the recording apparatus, it is obvious that the present invention is effective in terms of improvement in accuracy in managing the amount of waste ink.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-238626 filed Aug. 18, 2004, which is hereby incorporated by reference herein in its entirety.

What is claimed is:

1. A recording apparatus capable of performing full-surface recording that involves recording on an entire surface of a recording medium by ejecting ink to an area extending off the recording medium, the apparatus including a recording head configured to scan the recording medium along a scanning direction and to eject ink, and the recording apparatus comprising:

a print buffer configured to store recording data in relationship to the scanning direction, the recording data being inputted from an external device;

a counting unit dividing the print buffer into a plurality of segments and counting, on a segment-by-segment basis, an amount of recording data used by the recording head to perform a recording operation;

a selecting unit comparing the recording medium to the print buffer with respect to the scanning direction and, from the plurality of segments, selecting segments not corresponding to an inside of the recording medium;

a calculating unit counting the amount of recording data included in the segments selected by the selecting unit and causing a recording operation to occur, and calculating a cumulative amount of the recording data; and an estimating unit estimating, based on the cumulative amount calculated by the calculating unit, an amount of waste ink ejected from the recording head to an outside of the recording medium in the full-surface recording.

2. The recording apparatus according to claim 1, further comprising a waste ink absorber configured to absorb the waste ink ejected to the outside the recording medium in the full-surface recording.

3. The recording apparatus according to claim 1, wherein the selecting unit selects the segments not corresponding to the inside of the recording medium according to a size of the recording medium in the scanning direction and a number of bits of recording data expressing a pixel recorded by the recording head.

4. The recording apparatus according to claim 3, wherein the selecting unit selects the segments based on a recording resolution of the recording head.

5. The recording apparatus according to claim 1, further comprising an accumulating unit accumulating the amount of waste ink ejected from the recording head to the outside of the recording medium, the amount of waste ink being estimated by the estimating unit.

6. The recording apparatus according to claim 5, wherein the accumulating unit comprises a nonvolatile memory storing the accumulated amount of waste ink.

7. The recording apparatus according to claim 6, further comprising:

a comparing unit comparing the accumulated amount of waste ink with a predetermined threshold, the accumulated amount being stored in the nonvolatile memory; and a recording control unit controlling subsequent recording operations according to the comparison by the comparing unit.

8. A waste-ink estimating method for estimating the amount of waste ink during full-surface recording in a recording apparatus that ejects ink through a recording head while causing the recording head to scan a recording medium, the full-surface recording involving recording on an entire surface of the recording medium by ejecting ink to an area extending off the recording medium, the method comprising:

a counting step of dividing a print buffer into a plurality of segments and counting, on a segment-by-segment basis, an amount of recording data used by the recording head to perform a recording operation, the print buffer being provided for storing recording data in relationship to a scanning direction of the recording head, the recording data being inputted from an external device;

a selecting step of comparing the recording medium to the print buffer with respect to the scanning direction of the recording head and, and from the plurality of segments, selecting segments not corresponding to an inside of the recording medium;

a calculating step of counting the amount of recording data included in the segments selected in the selecting step and causing a recording operation to occur, and calculating a cumulative amount of the recording data; and an estimating step of estimating, based on the cumulative amount calculated in the calculating step, the amount of waste ink ejected from the recording head to an outside of the recording medium in the full-surface recording.

* * * * *